US009027367B2

(12) United States Patent
Shepley, Jr. et al.

(10) Patent No.: US 9,027,367 B2
(45) Date of Patent: May 12, 2015

(54) KNITTED VELCRO SLEEVE

(71) Applicant: Southern Weaving Company, Greenville, SC (US)

(72) Inventors: Joseph M. Shepley, Jr., Concord, NC (US); William J. Powers, Greenville, SC (US)

(73) Assignee: Southern Weaving Company, Greenville, SC (US)

( * ) Notice: Subject to any disclaimer, the term of this patent is extended or adjusted under 35 U.S.C. 154(b) by 0 days.

(21) Appl. No.: 13/754,020

(22) Filed: Jan. 30, 2013

(65) Prior Publication Data

US 2013/0139555 A1 Jun. 6, 2013

Related U.S. Application Data

(63) Continuation of application No. 13/021,854, filed on Feb. 7, 2011, now Pat. No. 8,468,853.

(51) Int. Cl.

| | |
|---|---|
| ***D04B 23/08*** | (2006.01) |
| ***D04B 1/22*** | (2006.01) |
| ***D04B 21/20*** | (2006.01) |
| ***D04B 21/14*** | (2006.01) |

(52) U.S. Cl.

CPC ..... *D04B 1/22* (2013.01); *D10B 2501/0632* (2013.01); *D04B 21/20* (2013.01); *D04B 21/14* (2013.01)

(58) Field of Classification Search

CPC ..... D04B 1/22; D04B 1/225; D04B 21/20; D04B 21/14; D04B 21/205

USPC ..... 66/193, 195, 191, 192

See application file for complete search history.

(56) References Cited

U.S. PATENT DOCUMENTS

| | | | | |
|---|---|---|---|---|
| 810,553 | A | 1/1906 | Neff et al. | |
| 2,239,293 | A | 4/1941 | Mosier et al. | |
| 3,513,668 | A * | 5/1970 | Mintz | 66/193 |
| 4,016,911 | A | 4/1977 | Looker | |
| 4,024,895 | A | 5/1977 | Barron | |
| 4,120,052 | A * | 10/1978 | Butler | 2/16 |
| 4,237,684 | A | 12/1980 | Hilton | |

(Continued)

FOREIGN PATENT DOCUMENTS

| | | |
|---|---|---|
| CH | 701337 A2 | 12/1978 |
| DE | 1773292 | 6/1956 |

(Continued)

OTHER PUBLICATIONS

PCT Partial International Search Report for PCT/US2013/069713; Our Ref. No. 37964/09008-PCT Feb. 12, 2014.

(Continued)

*Primary Examiner* — Danny Worrell

(74) *Attorney, Agent, or Firm* — Nelson Mullins Riley & Scarborough, LLP

(57) ABSTRACT

A knit fabric for use as a wrap around-sleeve having connectors along opposed edges. The fabric comprises a body portion knitted in a single layer of warp and weft yarns, a first edge portion of warp and weft yarns formed into spaced chains which secure a woven tape having hooks onto the knit fabric and a second edge knit to form raised loops. The hooks secured along the first edge are adapted to secure with the loops along the second edge securing the fabric edges forming the fabric into a wrap-around sleeve.

6 Claims, 8 Drawing Sheets

(56) References Cited

U.S. PATENT DOCUMENTS

| | | | | | |
|---|---|---|---|---|---|
| 4,330,887 | A | * | 5/1982 | White | 2/16 |
| 4,386,438 | A | * | 6/1983 | Evin | 2/272 |
| 4,543,805 | A | * | 10/1985 | Yoshida et al. | 66/148 |
| 4,643,119 | A | * | 2/1987 | Langston et al. | 112/421 |
| 4,677,011 | A | * | 6/1987 | Matsuda | 428/88 |
| 4,838,044 | A | * | 6/1989 | Matsuda et al. | 66/190 |
| 4,850,629 | A | * | 7/1989 | St. Germain | 294/74 |
| 4,858,447 | A | * | 8/1989 | Matsuda | 66/191 |
| 4,896,378 | A | * | 1/1990 | Campana | 2/170 |
| 5,033,124 | A | * | 7/1991 | Bucalo et al. | 2/227 |
| 5,035,125 | A | * | 7/1991 | Frohlich et al. | 66/193 |
| 5,070,541 | A | * | 12/1991 | Goss | 2/16 |
| 5,178,923 | A | * | 1/1993 | Andrieu et al. | 428/36.1 |
| 5,238,278 | A | | 8/1993 | Kamper | |
| 5,300,337 | A | * | 4/1994 | Andrieu et al. | 428/36.1 |
| 5,452,591 | A | * | 9/1995 | King | 66/83 |
| 5,477,891 | A | | 12/1995 | Benesi | |
| 5,504,944 | A | * | 4/1996 | Bromer et al. | 2/269 |
| 5,520,021 | A | * | 5/1996 | Clerici | 66/193 |
| 5,592,977 | A | | 1/1997 | Kikuchi et al. | |
| 5,634,499 | A | | 6/1997 | Kikuchi et al. | |
| 5,638,546 | A | * | 6/1997 | Vita | 2/16 |
| 5,664,441 | A | * | 9/1997 | Clerici | 66/193 |
| 5,771,942 | A | * | 6/1998 | Bunger | 139/11 |
| 5,857,359 | A | * | 1/1999 | Matsuda et al. | 66/193 |
| 5,913,903 | A | * | 6/1999 | Matsuda et al. | 66/85 R |
| 5,924,311 | A | * | 7/1999 | Matsuda et al. | 66/85 R |
| 6,006,552 | A | * | 12/1999 | Matsuda et al. | 66/193 |
| 6,148,643 | A | * | 11/2000 | Matsuda et al. | 66/193 |
| 6,265,039 | B1 | | 7/2001 | Drinkwater et al. | |
| 6,328,080 | B1 | * | 12/2001 | Winters | 139/388 |
| 6,639,148 | B2 | * | 10/2003 | Marks | 174/36 |
| 6,971,253 | B2 | * | 12/2005 | Matsuda et al. | 66/193 |
| 7,207,195 | B2 | * | 4/2007 | Okawa | 66/193 |
| 7,293,434 | B2 | * | 11/2007 | Ikeguchi et al. | 66/193 |
| 7,387,001 | B2 | * | 6/2008 | Wakata et al. | 66/195 |
| 7,395,680 | B2 | * | 7/2008 | Baer et al. | 66/170 |
| 7,520,304 | B2 | * | 4/2009 | Shimono et al. | 139/384 B |
| 7,576,286 | B2 | * | 8/2009 | Chen | 174/117 M |
| 7,658,423 | B1 | | 2/2010 | Carmichael | |
| 7,735,933 | B2 | | 6/2010 | Shimazaki | |
| 2004/0098963 | A1 | | 5/2004 | Calleeuw et al. | |
| 2008/0185409 | A1 | * | 8/2008 | Kellenberger | 224/257 |
| 2009/0152885 | A1 | * | 6/2009 | Summars | 294/74 |
| 2009/0252961 | A1 | * | 10/2009 | Eguchi et al. | 428/373 |
| 2010/0071119 | A1 | * | 3/2010 | Thatcher | 2/458 |
| 2010/0084179 | A1 | * | 4/2010 | Harris et al. | 174/350 |

FOREIGN PATENT DOCUMENTS

| | | | |
|---|---|---|---|
| DE | 10325701 | A1 | 12/2004 |
| DE | 10325791 | A1 | 12/2004 |
| EP | 0498253 | A1 | 1/1992 |
| EP | 1336675 | A2 | 8/2003 |
| GB | 1235 | | 0/1909 |
| WO | W02011009924 | A2 | 1/2011 |
| WO | W02014075085 | A2 | 5/2014 |

OTHER PUBLICATIONS

PCT Partial International Search Report for PCT/US2013/069713; Our Ref. No. 37964/09008-PCT.

PCT invitation to Pay Additional Fees and, Where Applicable, Protest Fee mailed Feb. 25, 2014 for PCT/ US2013/069713; Mailed Feb. 12, 2014; Our Ref. No. 37964/09008-PCT.

Gates Corporation Brochure Entitled "There's a Better Way to Protect Against Hydraulic Hose Failure."; printed by Gates Corporation in USA in 2008.

Gates Corporation article entitled "Line-of-Sight Sleeving is the Safest Alternative for Protecting Operators and Personnel" Copyright 2008 Gates Corporation, pp. 1-3.

* cited by examiner

BottomHook Tape Attachment

Back of Loop Knitted on Web

Front of Webbing (Loop side)

Webbing Structure with Loop Multi-Strand Yarn Knitted into Webbing

KNITTED VELCRO SLEEVE

CROSS-REFERENCE TO RELATED APPLICATIONS

This application is a Continuation of U.S. patent application Ser. No. 13/021,854 filed on Feb. 7, 2011 and published as U.S. Published Patent Application No. 2012/0198893, the contents of which is incorporated herein in its entirety.

BACKGROUND OF THE INVENTION

The instant invention is directed to a knit fabric having connectors along its laterally spaced longitudinal edges. The fabric has as its primary use the formation of a sleeve which may be wrapped about wiring or other articles to act as an insulator, protective cover or positioning member. The fabric, including the connectors, is formed in a single step by knitting.

Sleeve or cover fabrics are known. These fabrics are primarily formed by weaving or knitting a web with loop connectors formed along one edge. A tape, carrying hook members, is then sewn or adhered to the opposite edge of the web. This procedure, while an improvement over attaching connector tapes along both edges of a formed web, is time-consuming and inefficient.

Accordingly, a primary object of the instant invention is the method of forming a fabric having connectors along opposed edges in a single step.

Another object of the invention is the provision of a unitary knitted cover fabric having hook and loop connectors along opposed edges.

Another object of the invention is a knitted cover fabric in which the hook members are secured therewith by knitting during the formation of the cover fabric.

Another object of the invention is the formation of a knit fabric having connectors along each edge in a single continuous operation.

Another object of the invention is an improved and more economical method of forming a knit cover fabric.

SUMMARY OF THE INVENTION

The instant invention is directed to a knit cover fabric having connectors arranged along its longitudinal edges and the method of forming.

The method of forming the cover fabric includes the steps of preparing a plurality of warp and weft yarns and a tape carrying a plurality of connectors over one surface for delivery through the knitting zone of a knitting machine. The yarns, along with the tape, are fed through the knitting zone which operates to form a knitted web having first and second edges. The tape is fed simultaneously with the yarns through the knitting zone where it is secured with the knitted web by being knitted onto a first edge of the knitted web during its formation. Also, occurring simultaneously with the formation of the knitted web, loops are formed along its second edge. The loops are formed by knitting on a first web side simultaneously with the tape being knitted onto the opposite web side.

The fabric comprises a knit web having a body portion with laterally spaced edges. The web is formed of first, second and third yarn groups. The body portion of the web is formed of yarns of the first and second groups. A first edge of the web is formed of yarns of the first and second yarn groups while second edge is formed of yarns of the first, second and third yarn groups.

The first and second yarn groups knit with a fabric strip or tape having hook elements along one of its surfaces securing the fabric strip along the first edge and lower side of knit web.

The third yarn group knits with the yarns of the first and second yarn groups along the second edge forming loops along the upper side of the fabric. The loops formed by the third yarn group extend above the yarns of groups one and two.

By securing the fabric strip on one web surface and forming the loops on the opposite fabric surface, the web edges may be arranged or curled to position the loops to overlay the hook elements so that when engaged, the web forms a continuous circular configuration.

The web or the yarns of the first and second yarn groups are preferably formed of monofilament yarns while the loops formed by the yarns of the third yarn group are preferably multifilament yarns. Preferably, all yarns are polymeric material.

The yarns of groups one and two form the web using a pillar stitch while yarn three forms the raised loops using a treco stitch.

DESCRIPTION OF THE DRAWINGS

The construction designed to carry out the invention will hereinafter be described, together with other features thereof.

DESCRIPTION OF THE PREFERRED EMBODIMENT

The invention will be more readily understood from a reading of the following specification and by reference to the accompanying drawings forming a part thereof.

Figure 1:
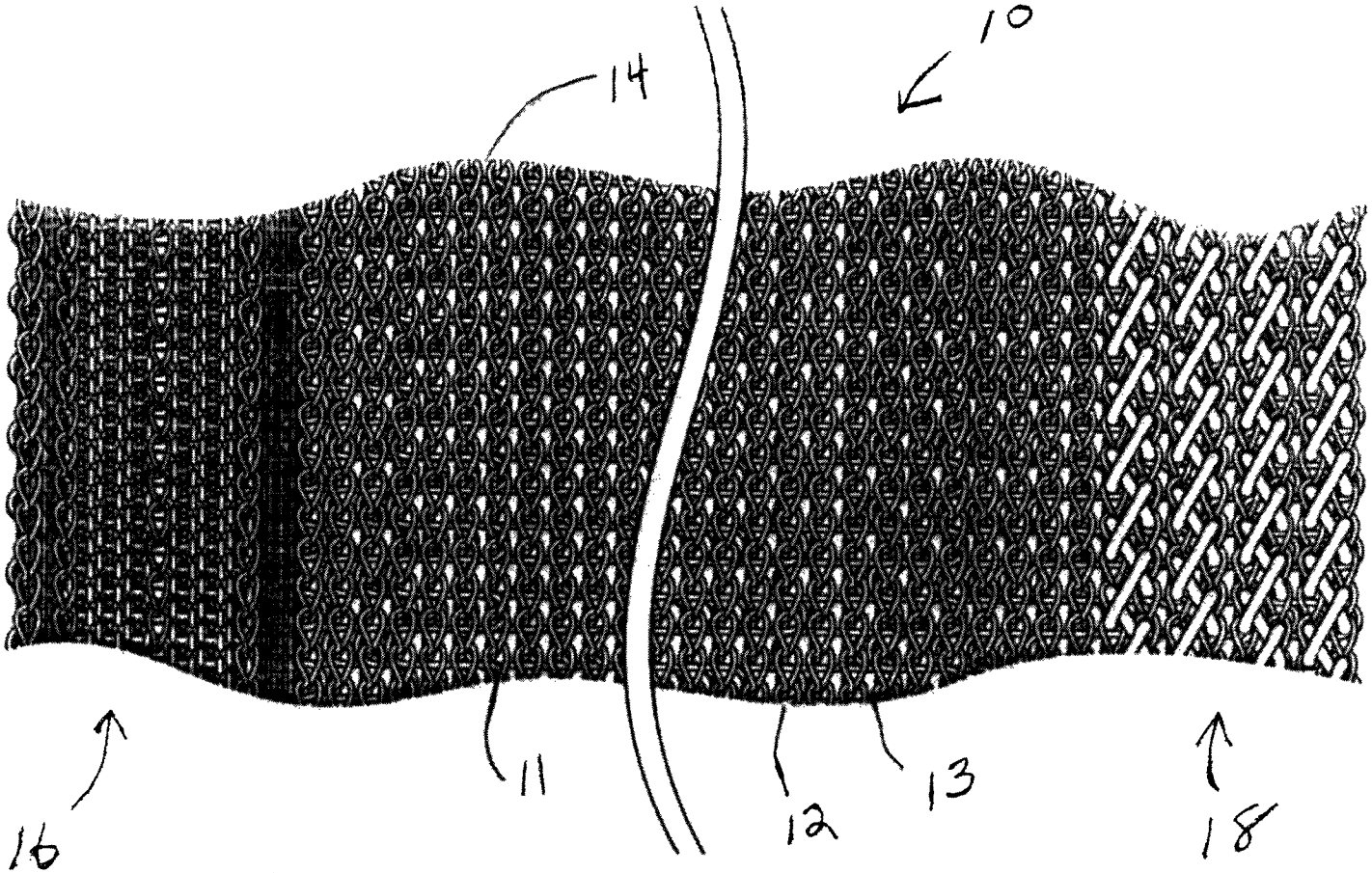
FIG. 1 is a top view of the back side of the combination fabric of the invention.

Turning now to the drawings, FIG. 1 is a top view showing closure fabric 10 from its top side. FIGS. 2-7 are also referenced. Fabric 10 is intended for use as a wrap-around sleeve cover or shield fabric for use with electrical wiring, furniture, automobile covering, etc. The fabric is constructed in a single continuous process by knitting. This single process provides both time and labor saving features which are very desirable.

Fabric 10 consists of body or web 11 which is formed to be of selective widths depending upon the intended use of the fabric. The width of the body may range between 2" to the width of the knitting machine. Body 11 is formed of vertical warp rows or chains 12, of preferably closed pillow stitches 13, inter-connective with weft yarns 14. The yarns forming warp rows or chains 12 are preferably a monofilament of polymeric material such as a polyester. The yarn size is determined by the intended end use. Weft bars lay weft yarns 14 transversely of the warp rows or chains 12 preferably passing the yarn over four rows or chains per stitch. The weft yarn 14 may be a multi-filament or monofilament polymeric yarn, preferably a polyester.

Turning now to FIGS. 4-9, fabric 10 is shown in sections illustrating the central portion or body 11 and the opposed edge portions 16 and 18. Loop edge 18 is constructed of between eight and ten warp chains or rows $\mathbf{12}^1$ formed of pillar stitches 13 slightly spaced from body 11 by a skipped chain or row 19. The same yarns are used to form both warp rows 12 and $\mathbf{12}^1$. Combined with pillar stitches 13 are tricot stitches 20 of multifilament yarns 22 which are fed to the same needles knitting with yarns 24 forming rows $\mathbf{12}^1$ forming raised loops 26 of additional loop forming stitches. The loop forming yarns 22 are knitted in a closed tricot stitch alternating with adjacent chains 12' positioning loops 26 above pillar stitches 13. Yarns 22 form the raised loops 26 along edge 18 on the upper surface of fabric 10. Again, weft yarns 14 engage with the respective stitches retaining the rows in position.

Figure 2:
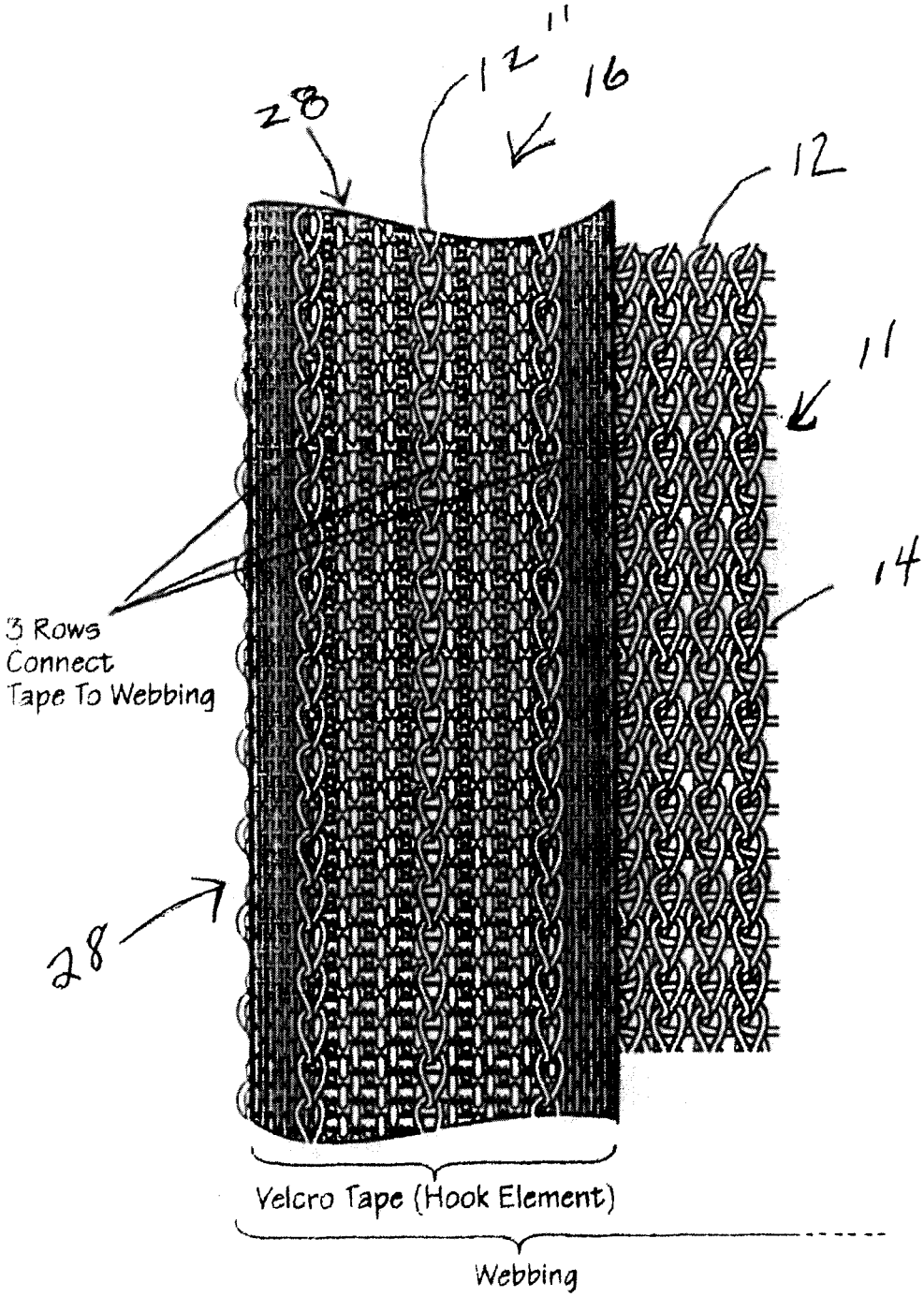
FIG. 2 is a top sectional view of the combination fabric showing the hook tape knitted onto the outer edge of the fabric web or body fabric.
Figure 3:
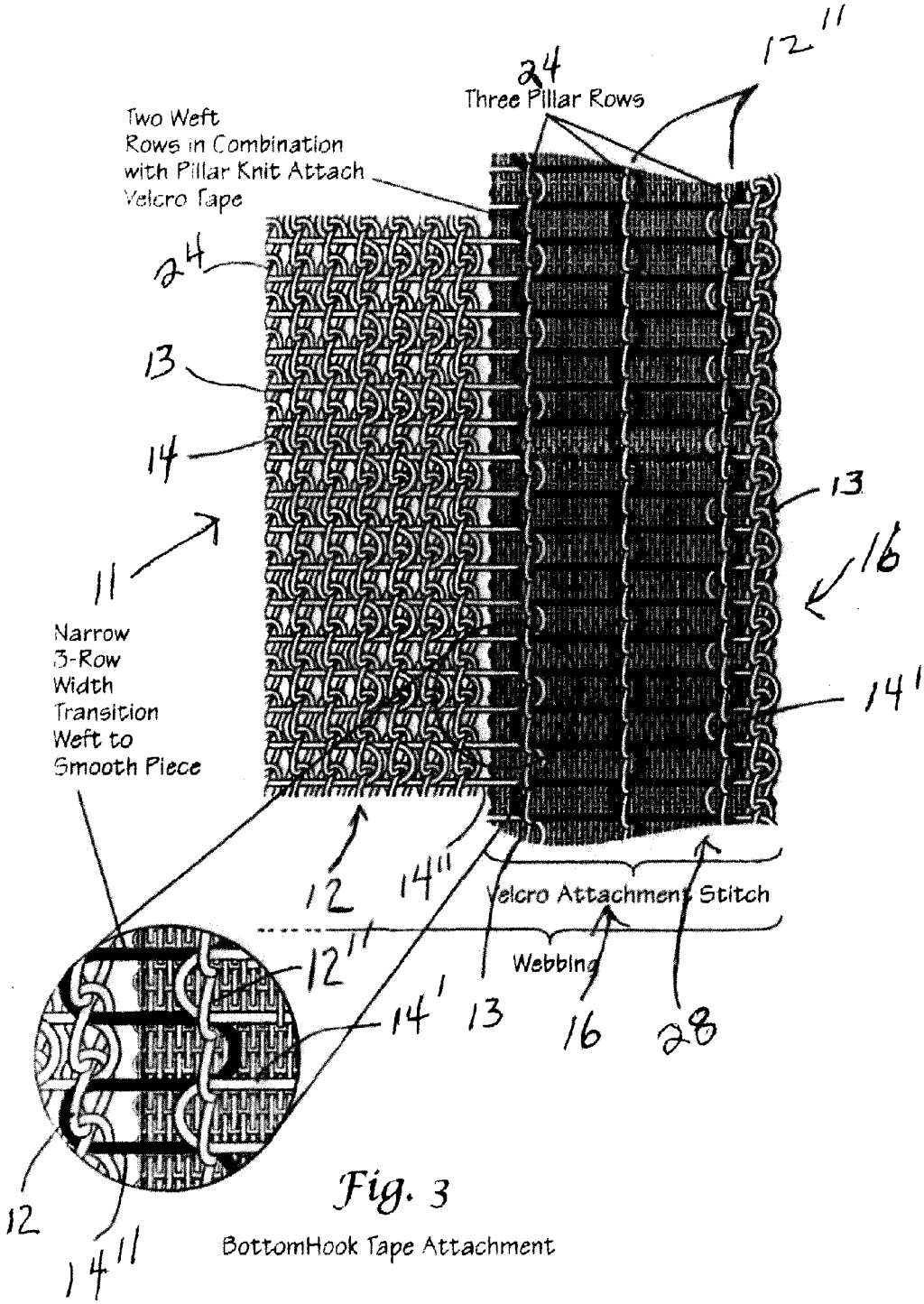
FIG. 3 is a bottom sectional view of the fabric of FIG. 2. An exploded section is included.
Figure 4:
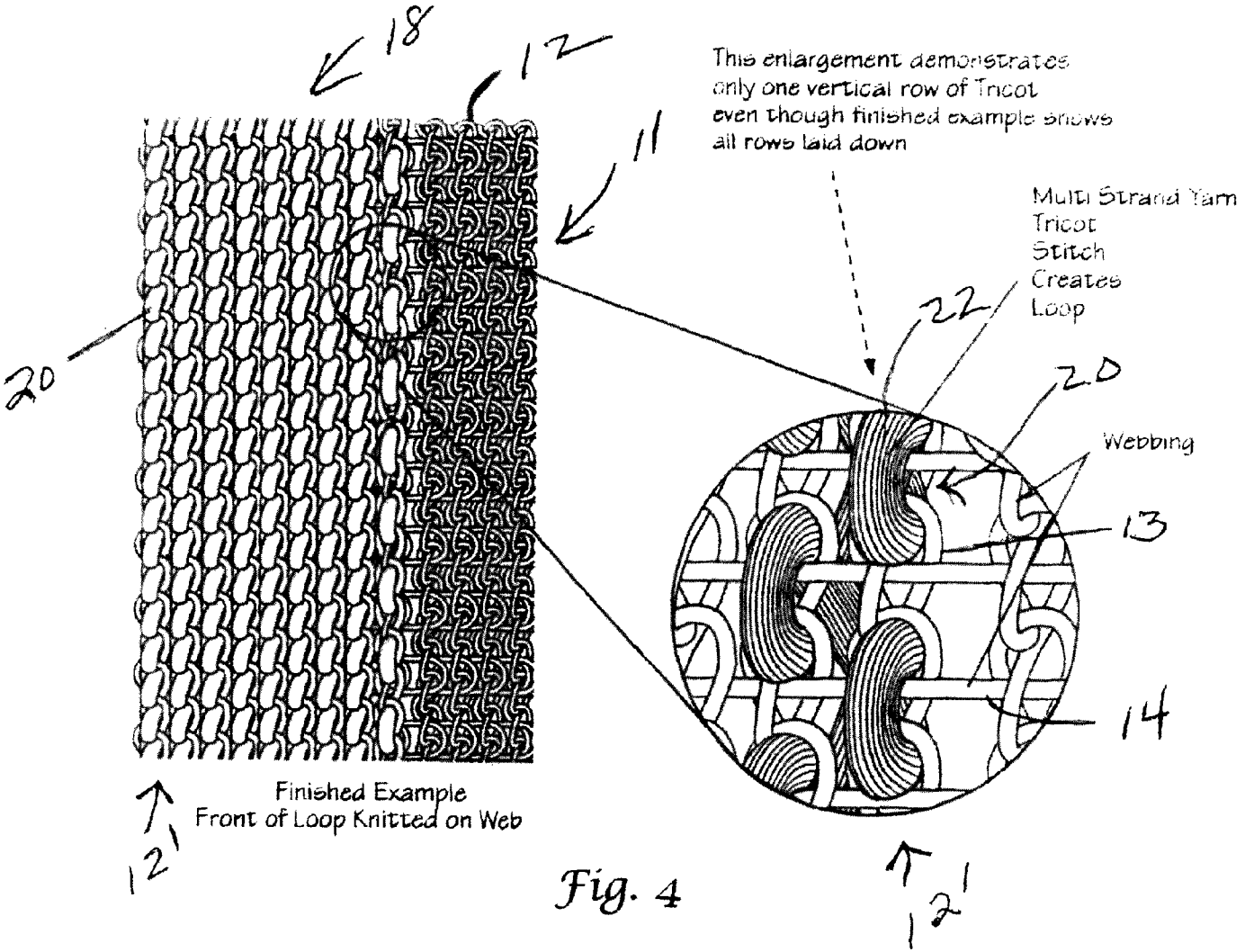
FIG. 4 is a top sectional view of the opposite side of the combination fabric showing the loops section knitted onto the outer edge of the fabric. An exploded section is included.
Figure 5:
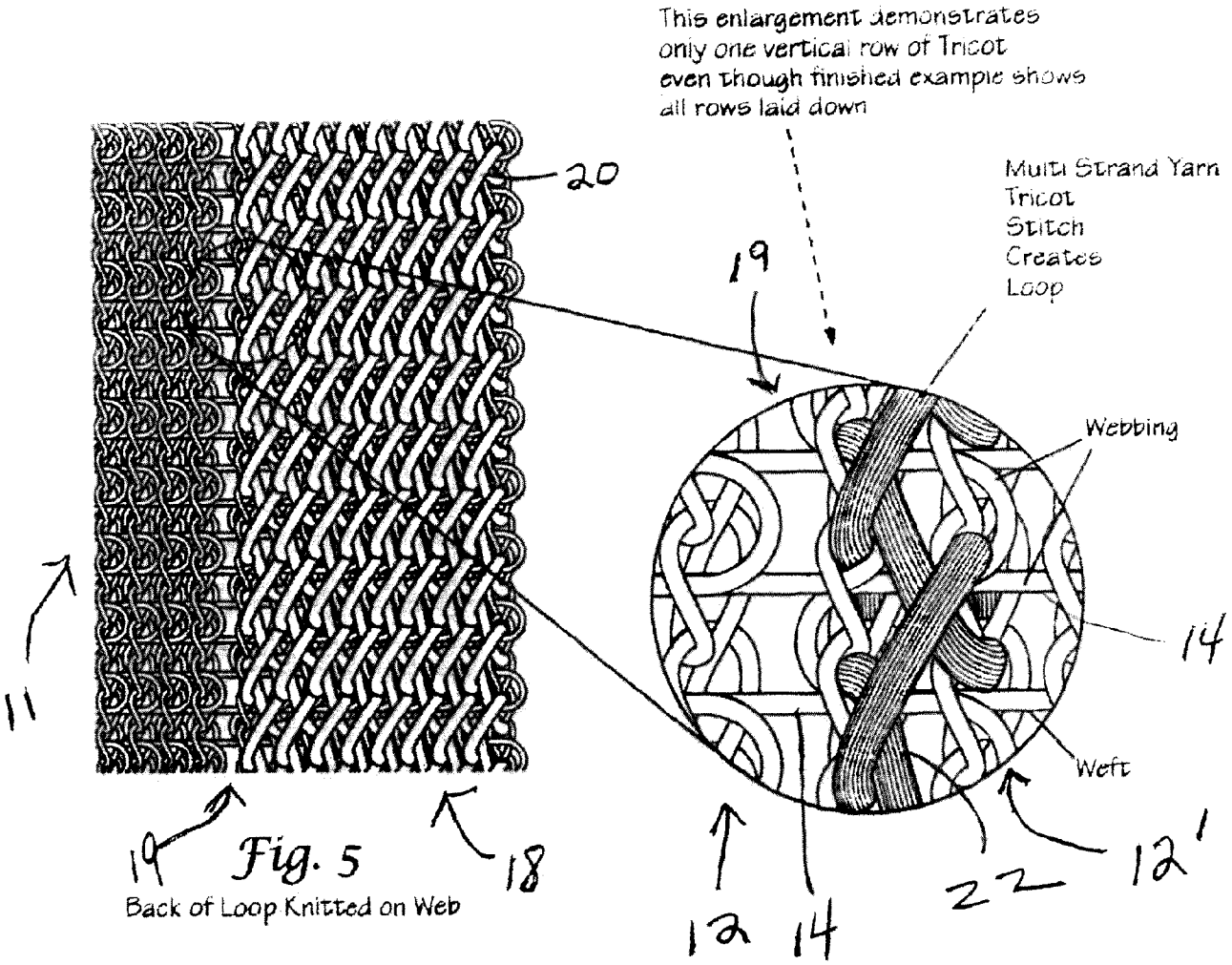
FIG. 5 is a bottom sectional view of the fabric showing the exposed loops. An exploded section is included
Figure 6:
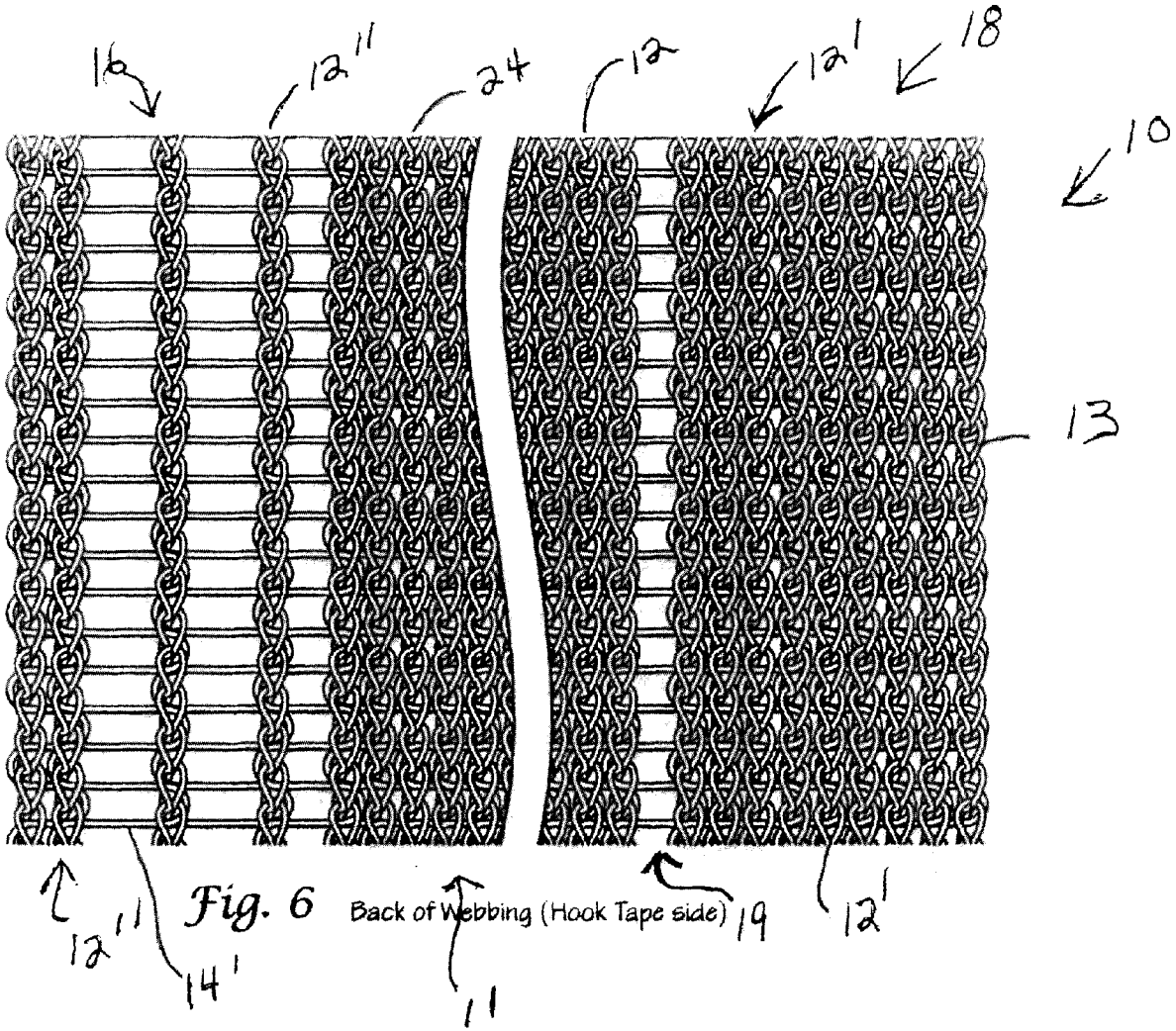
FIG. 6 is a back view of the body or web section along with the first edge of the combination without the hook section or the loop section incorporated therewith.
Figure 7:
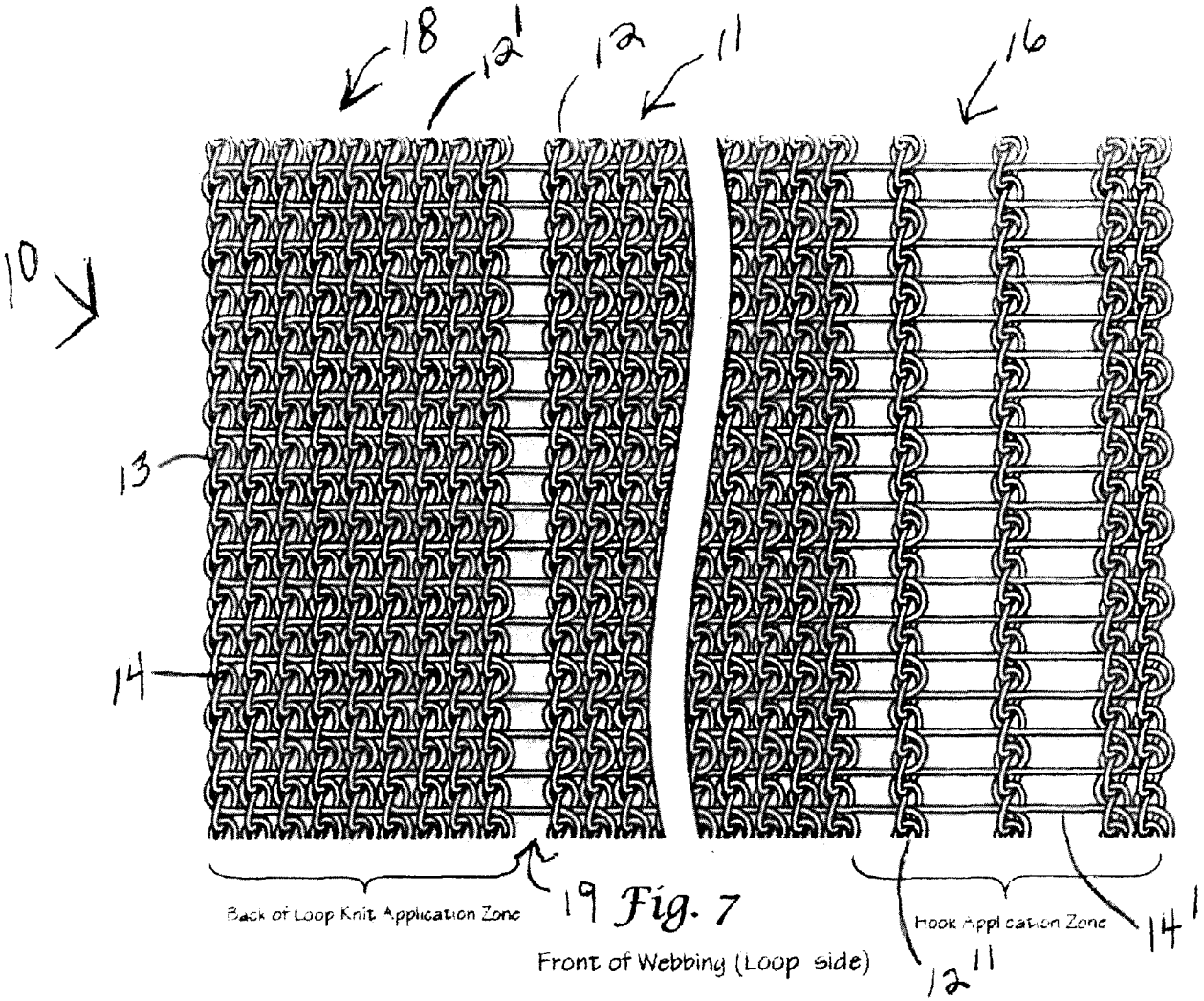
FIG. 7 is a back view similar to FIG. 6 showing the second edge.
Figure 8:
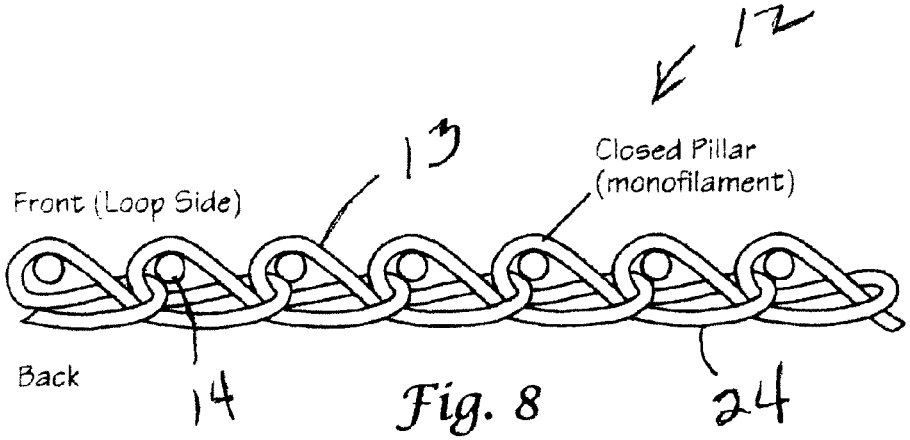
FIG. 8 is a side sectional view of the fabric web taken along an inner vertical row of FIG. 7.
Figure 9:
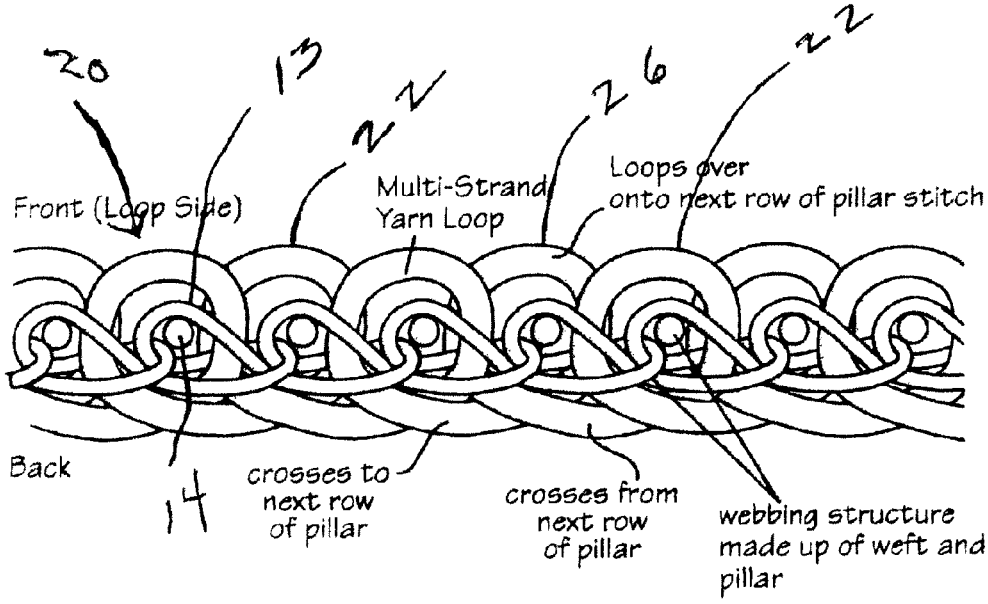
FIG. 9 is a side sectional view of the loop structure taken along an edge row of FIG. 5.

Turning now to FIGS. 1-3, body 11 of fabric 10 is shown connecting along its edge 16 with a hook containing tape 28 which is usually woven. As is shown in FIG. 2, the preformed hook containing tape 28 is positioned adjacent the edge of the knitting zone on the knitting machine and fed simultaneously through the knitting zone with warp yarns 24 forming the body portion 11 and warp chains 12 and $\mathbf{12}^{11}$. Tape 28 is fed beneath yarns 24 so as to appear on the lower surface of fabric 10. Again, chains $\mathbf{12}^{11}$ of edge 16 are spaced across the knitting zone there being usually about four chains forming edge 16. Weft yarns $\mathbf{14}^1$ are passed also to be engaged with chain loops 24 of chains $\mathbf{12}^{11}$. Chains $\mathbf{12}^{11}$ are spaced a distance so that each weft yarn $\mathbf{14}^1$ passes over and engages within only two chains in edge 16. Weft yarn $\mathbf{14}^{11}$ engages with the outermost chain 12 of body 11 and the innermost chain $\mathbf{12}^{11}$ of edge 16 securing the edge portion with body 11.

Hook carrying tape 28, which is a standard hook tape of a hook and loop engagement system, i.e. VELCRO, is positioned to be fed through the knitting zone superimposed under warp yarns 24 forming chains $\mathbf{12}^{11}$. As yarns 24 and tape 28 are fed through the knitting zone, the needles forming stitches or loops 13 pass through hook tape 28 allowing the yarns 24 forming chains $\mathbf{12}^{11}$ to engage with weft $\mathbf{14}^1$ securing the tape on the edge portion 16. Weft yarn 14' engages with chains $\mathbf{12}^{11}$ on the back surface of tape 28. Simultaneously, the pillar stitches of chains $\mathbf{12}^{11}$ are formed on the hook side of tape 28 securing it with the lower side of fabric 10. An additional chain $\mathbf{12}^{11}$ is formed outwardly of the edge of hook tape 28 forming the finished edge of fabric 10.

Fabric 10 is formed as a finished product with tape 28 secured to a first side and edge of the fabric and loops 26 formed along the opposed edge and opposite fabric side, in a single operation. By removing unnecessary processing and handling steps, the fabric is produced in a most economical manner. Less handling further reduces the number of second or faulty products.

The size or denier of the yarns forming fabric 10 may vary between very fine to very course, depending upon the intended use of the finished product. Also, the synthetic yarns forming the fabric may vary also between various type polymeric material also depending upon the intended use and between mono or multifilament yarns as desired. Finally, the size and shape of the fabric varies depending upon the intended use. Primarily, monofilament yarns are preferred for all fabric sections except for the loop forming yarns. Here, multifilament yarns are preferred.

While a preferred embodiment of the invention has been described using specific terms, such description is for illustrative purposes only, and it is to be understood that changes and variations may be made without departing from the spirit or scope of the following claims.

What is claimed is:

1. A knit fabric having connectors along opposed edges comprising:

a body portion having laterally spaced first and second edges formed by knitting warp and weft yarns together;

a tape, having first connectors over its outer surface, knitted onto said body portion along said first edge;

second connectors knitted onto said body portion along said second edge; whereby said first connectors and second connectors inter-engage when overlaid forming said fabric tubular; and wherein said warp yarns form a plurality of spaced stitch chains extending in the warp direction of said fabric and which are spaced apart in the weft direction, selected of said chains being spaced a greater distance in the weft direction from adjacent of said chains than the remainder of said chains.

2. The fabric of claim 1 wherein certain of said selected chains secure said tape with said body portion.

3. A fabric of claim 1 wherein said first connectors are arranged along a surface of said body portion and said second connectors are arranged along an opposing surface of said body portion.

4. The fabric of claim 1 wherein said first connectors comprise hook members.

5. The fabric of claim 1 wherein said second connectors comprise loop members.

6. The fabric of claim 1 wherein said yarns forming said fabric comprise polymeric monofilament and multifilament yarns.

* * * * *